US010175601B2

(12) United States Patent
Yamazaki et al.

(10) Patent No.: US 10,175,601 B2
(45) Date of Patent: Jan. 8, 2019

(54) CLEANING DEVICE AND IMAGE FORMING APPARATUS

(71) Applicant: FUJI XEROX CO., LTD., Tokyo (JP)

(72) Inventors: Shuhei Yamazaki, Kanagawa (JP); Keiichiro Sato, Kanagawa (JP); Yasuhiro Funayama, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/784,193

(22) Filed: Oct. 16, 2017

(65) Prior Publication Data

US 2018/0275554 A1 Sep. 27, 2018

(30) Foreign Application Priority Data

Mar. 23, 2017 (JP) ..... 2017-057920

(51) Int. Cl.
*G03G 15/02* (2006.01)

(52) U.S. Cl.
CPC ..... *G03G 15/0258* (2013.01); *G03G 15/0225* (2013.01)

(58) Field of Classification Search
CPC ..... G03G 15/0225; G03G 15/0258
See application file for complete search history.

(56) References Cited

U.S. PATENT DOCUMENTS 7,062,194 B2 * 6/2006 Yanagida ..... G03G 15/0225 399/100

FOREIGN PATENT DOCUMENTS

| | | |
|---|---|---|
| JP | 11-184213 | 7/1999 |
| JP | 2002-162813 | 6/2002 |
| JP | 2004-054141 | 2/2004 |

* cited by examiner

*Primary Examiner* — Hoang Ngo
(74) *Attorney, Agent, or Firm* — JCIPRNET

(57) ABSTRACT

A cleaning device includes a cleaning member, a first bearing member, a second bearing member, and a moving mechanism. The cleaning member includes a shaft portion and an elastic layer disposed around the shaft portion. The elastic layer is brought into contact with a rotating charging body. The cleaning member cleans the charging body while rotating. The first bearing member supports a first end portion of the shaft portion while rendering the shaft portion rotatable. The second bearing member supports a second end portion of the shaft portion while rendering the shaft portion rotatable. The moving mechanism is supported by the first bearing member and the second bearing member. The moving mechanism periodically moves the shaft portion in an axial direction of the shaft portion together with a rotation of the cleaning member.

6 Claims, 6 Drawing Sheets

CLEANING DEVICE AND IMAGE FORMING APPARATUS

CROSS-REFERENCE TO RELATED APPLICATIONS

This application is based on and claims priority under 35 USC 119 from Japanese Patent Application No. 2017-057920 filed Mar. 23, 2017.

BACKGROUND

Technical Field

The present invention relates to a cleaning device and an image forming apparatus.

SUMMARY

According to an aspect of the invention, a cleaning device includes a cleaning member, a first bearing member, a second bearing member, and a moving mechanism. The cleaning member includes a shaft portion and an elastic layer disposed around the shaft portion. The elastic layer is brought into contact with a rotating charging body. The cleaning member cleans the charging body while rotating. The first bearing member supports a first end portion of the shaft portion while rendering the shaft portion rotatable. The second bearing member supports a second end portion of the shaft portion while rendering the shaft portion rotatable. The moving mechanism is supported by the first bearing member and the second bearing member. The moving mechanism periodically moves the shaft portion in an axial direction of the shaft portion together with a rotation of the cleaning member.

BRIEF DESCRIPTION OF THE DRAWINGS

Exemplary embodiments of the present invention will be described in detail based on the following figures, wherein.

DETAILED DESCRIPTION

Figure 1:
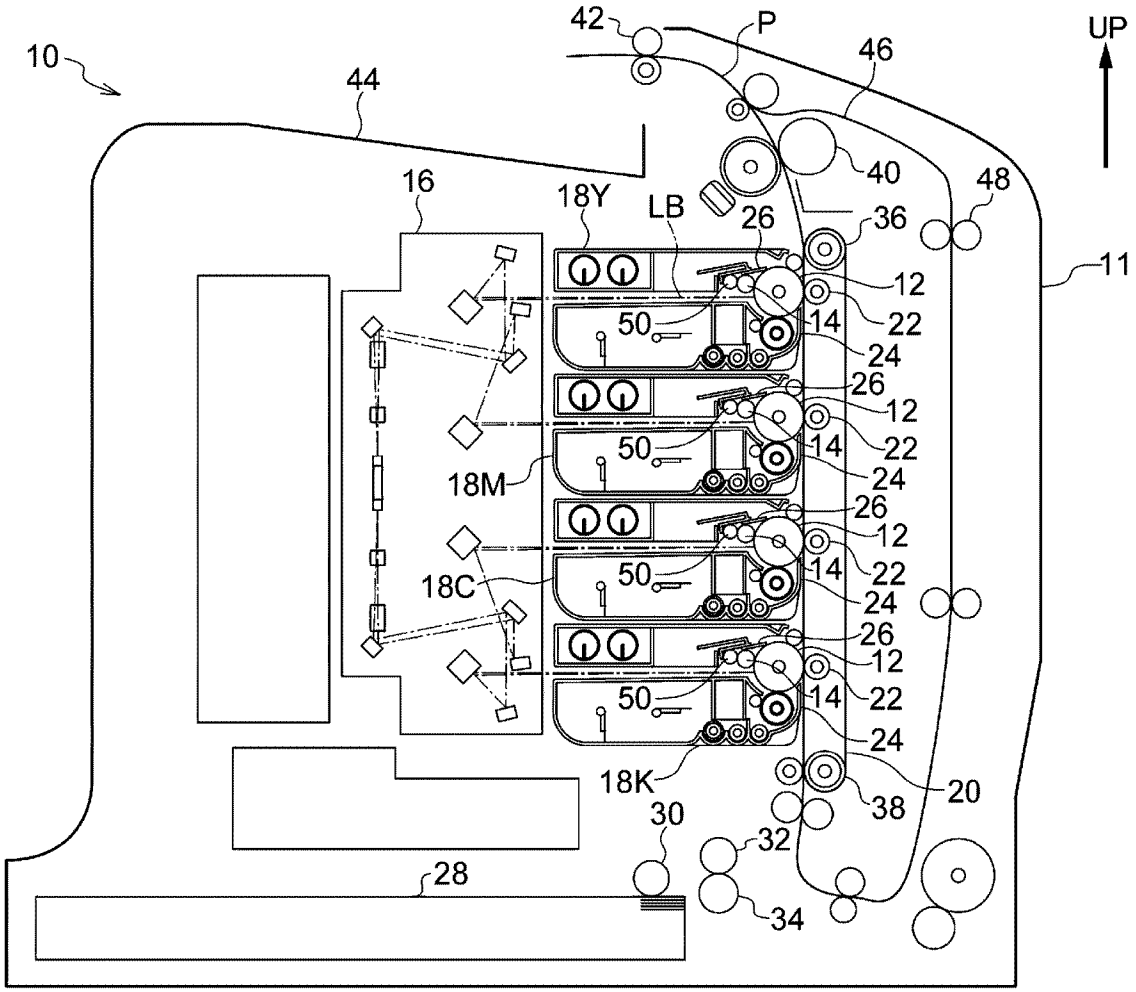
FIG. 1 is a schematic diagram of the structure of an image forming apparatus according to an exemplary embodiment.

Exemplary embodiments of the present invention are described below in details with reference to the drawings. An image forming apparatus 10 according to an exemplary embodiment is, for example, a tandem full-color image forming apparatus, as illustrated in FIG. 1. In FIG. 1, arrow UP denotes an upward direction of the image forming apparatus 10. Components having the same functions may be denoted with the same reference symbols (symbols of alphabetic abbreviation).

A schematic structure of the image forming apparatus 10 is described first. As illustrated in FIG. 1, the image forming apparatus 10 includes an apparatus body 11. Inside the apparatus body 11, the image forming apparatus 10 includes process cartridges 18K, 18C, 18M, and 18Y corresponding to black (K), cyan (C), magenta (M), and yellow (Y) in order from the bottom.

Each process cartridge 18 includes a photoconductor 12, which is an example of an image carrier (a charged body) capable of holding images, a charging device 15 (see FIG. 2) including a charging roller 14, which is an example of a charging body (a body that is to be cleaned), and a developing device 24. Each process cartridge 18 is attachable to and detachable from the apparatus body 11.

The photoconductor 12 is rotatably supported by side plates 82 (see FIG. 3) at both ends in the rotation axis direction. The outer circumferential surface of the photoconductor 12 is charged by the charging roller 14, which is disposed in contact with the outer circumferential surface of the photoconductor 12, and then exposed to a laser beam LB emitted from an exposure device 16, which is disposed downstream of the charging roller 14 in the rotation direction of the photoconductor 12. Thus, an electrostatic latent image corresponding to image information is formed on the outer circumferential surface of the photoconductor 12.

An electrostatic latent image formed on the outer circumferential surface of each photoconductor 12 is developed by the corresponding one of the developing devices 24 for black (K), cyan (C), magenta (M), and yellow (Y) into a toner image of the corresponding color. Specifically, the outer circumferential surface of each of the photoconductors 12 for black (K), cyan (C), magenta (M), and yellow (Y) is subjected to charging, light exposure, and development, so that a toner image of the corresponding one of black (K), cyan (C), magenta (M), and yellow (Y) is formed on the outer circumferential surface of the photoconductor 12 for the corresponding color.

Recording sheets P are picked up by a pick-up roller 30 from a sheet storage 28 and transported by a transporting roller 32 and a transporting roller 34 to a transporting belt 20. The transporting belt 20 is wrapped around a driving roller 36 and a driven roller 38 under tension. The transporting belt 20 is moved by rotational driving of the driving roller 36 such that a portion facing the photoconductors 12 moves upward from the bottom. Transfer rollers 22 corresponding to the respective photoconductors 12 are disposed on the inner peripheral surface of the transporting belt 20.

Toner images of black (K), cyan (C), magenta (M), and yellow (Y) formed on the outer circumferential surfaces of the respective photoconductors 12 are sequentially transferred at respective transfer positions, at which the photoconductors 12 and the portions of the transporting belt 20 supported by the transfer rollers 22 face each other, from the outer circumferential surfaces of the respective photoconductors 12 to a recording sheet P transported to the transfer positions by the transporting belt 20. A recording sheet P to which toner images have been transferred from the outer circumferential surfaces of the respective photoconductors 12 is transported to a fixing device 40 to be heated and pressed, so that the toner images are fixed to the recording sheet P.

In single-side printing, the recording sheet P to which the toner images are fixed is discharged by a discharging roller 42 to a discharge portion 44 at an upper portion of the image forming apparatus 10. In double-side printing, on the other hand, a trailing end portion of the recording sheet P having the toner images fixed to its surface by the fixing device 40 is held by the discharging roller 42. Then, the discharging roller 42 rotates in the reverse direction to transport the recording sheet P to a transport path 46 for double-side printing.

The recording sheet P turned over by being transported by transporting rollers 48 disposed in the transport path 46 is transported again onto the transporting belt 20, on which toner images are transferred to the back surface of the recording sheet P from the outer circumferential surfaces of the respective photoconductors 12. The toner images that have been transferred to the back surface of the recording sheet P are fixed to the recording sheet P by the fixing device 40, and the recording sheet P carrying the toner images fixed onto the back surface is discharged onto the discharge portion 44 by the discharging roller 42.

Toner, paper dust, or other objects remaining on the outer circumferential surface of each photoconductor 12 after the toner image has been transferred to a recording sheet is removed by a cleaning blade 26, disposed downstream of the transfer position in the rotation direction of the photoconductor 12, every time the photoconductor 12 makes one rotation. Thus, the outer circumferential surface of each photoconductor 12 is prepared for the subsequent image forming step.

First Exemplary Embodiment

Now, the charging rollers 14 and cleaning devices 50 each including a cleaning roller 52, which is an example of a cleaning member that cleans the charging roller 14, are described.

Figure 2:
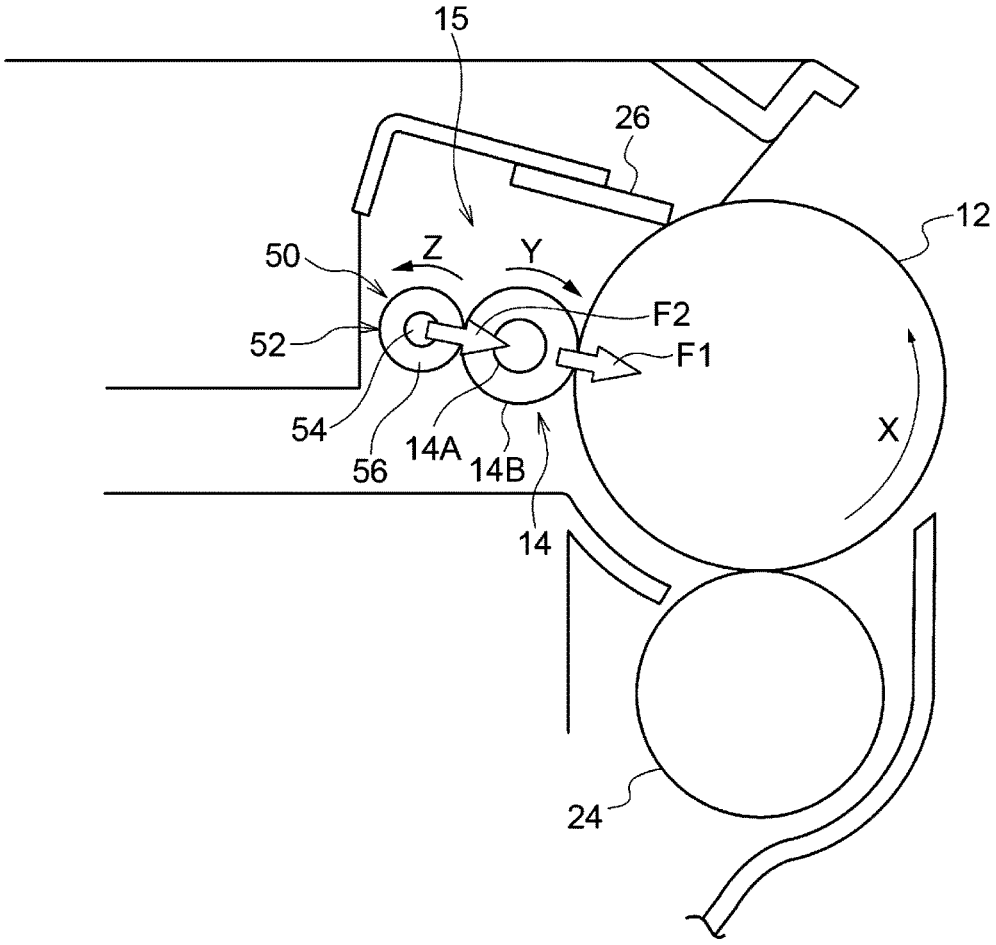
FIG. 2 is a schematic diagram of the structure of a cleaning device according to an exemplary embodiment viewed in an axial direction.
Figure 3:
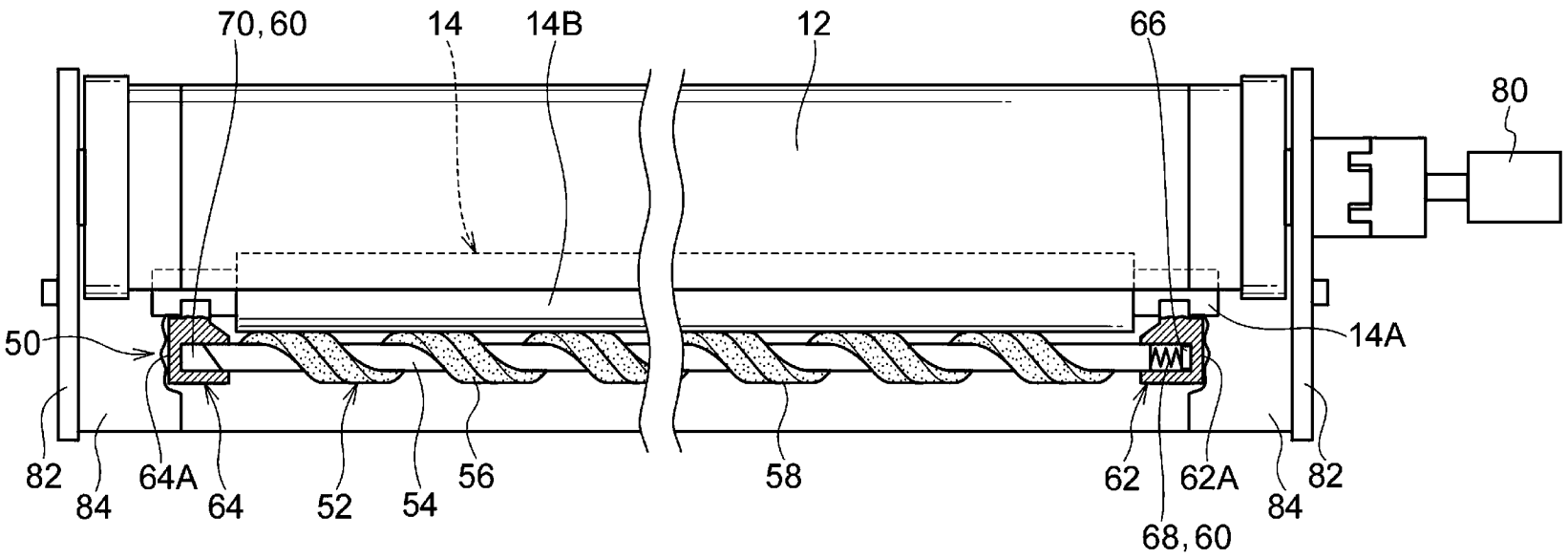
FIG. 3 is a schematic diagram of the structure of a cleaning device according to a first exemplary embodiment when viewed from the front.

As illustrated in FIGS. 2 and 3, each charging roller 14 is, for example, in the form of a roller including a shaft 14A and an elastic layer 14B surrounding the shaft 14A. Both ends of the shaft 14A are rotatably supported by a support member, not illustrated. When a load F1 (see FIG. 2) is imposed on both ends of the shaft 14A of the charging roller 14, the elastic layer 14B of the charging roller 14 is pressed against the outer circumferential surface of the corresponding photoconductor 12, and elastically deformed into the shape that fits for the outer circumferential surface of the photoconductor 12 to form a nip portion.

As illustrated in FIG. 2, when each photoconductor 12 is driven to rotate in the direction of arrow X by a motor 80 (see FIG. 3), the corresponding charging roller 14 is driven to rotate by the rotation of the photoconductor 12 in the direction of arrow Y. The corresponding cleaning roller 52, which is in contact with the charging roller 14 at a portion opposite to a portion of the charging roller 14 at which the photoconductor 12 is in contact, is driven to rotate in the direction of arrow Z by the rotation of the charging roller 14.

When a load F2 (see FIG. 2) is imposed on both ends of a shaft 54, described below, by a pair of bearing members 62 and 64 (see FIG. 3), described below, an elastic layer 56 of the cleaning roller 52, described below, is pressed against the outer circumferential surface of the elastic layer 14B of the charging roller 14, and elastically deformed into the shape that fits for the outer circumferential surface of the elastic layer 14B to form a nip portion. This cleaning roller 52 at least partially prevents the charging roller 14 from being bent.

Examples of the material of the shaft 14A of the charging roller 14 includes metals such as electrically conductive free-cutting steel and stainless steel. The surface treatment method or the like is appropriately selected for the material of the shaft 14A in accordance with the purposes of use including the sliding properties. A preferable material for the elastic layer 14B of the charging roller 14 is an electrically conductive elastic foam layer. The elastic material constituting the electrically conductive elastic foam layer is formed by, for example, dispersing an electrically conducting agent in a rubber material.

The elastic layer 14B of the charging roller 14 may have a single-layer structure or a multilayer structure including multiple layers having various different functions. A surface layer may be formed on the outer circumferential surface of the elastic layer 14B. The surface layer may be any layer including a resin layer and a rubber layer and is not limited to a particular one.

As illustrated in FIG. 3, the cleaning device 50 according to the first exemplary embodiment includes the cleaning roller 52, which is in the roller form. The cleaning roller 52 includes a shaft 54, which is an example of a shaft portion (core), and an elastic layer 56, which is helically wound around the outer circumferential surface of the shaft 54.

The shaft 54 extends in the rotation axis direction (hereinafter, simply referred to as an "axial direction") of the charging roller 14. The length of the shaft 54 in the axial direction is longer than that of the elastic layer 14B of the charging roller 14 in the axial direction.

Specifically, first and second end portions of the shaft 54 in the axial direction protrude outward in the axial direction beyond first and second end portions of the elastic layer 14B of the charging roller 14 in the axial direction.

Examples of the material of the shaft 54 include metals such as free-cutting steel and stainless steel and resins such as polyacetal resin (POM). The elastic layer 56 is an elastic foam layer made of a foamed material. The elastic layer 56 is made of a material that restores to the original state after being deformed with pressure of, for example, 100 Pa. Examples of the material of the elastic layer 56 include expandable resin such as polyurethane, polyethylene, polyamide, and polypropylene.

The elastic layer 56 is helically wound around the outer circumferential surface of the shaft 54 from the first end portion to the second end portion of the shaft 54 in the axial direction. Specifically, an adhesive layer, such as a double-sided tape, is disposed on the inner surface of the elastic layer 56 wound around the outer circumferential surface of the shaft 54. The elastic layer 56 is thus bonded with the adhesive layer to the outer circumferential surface of the shaft 54, while being helically wound from the first end portion to the second end portion of the shaft 54 in the axial direction.

The elastic layer 56 has a linear cut 58 extending in the longitudinal direction of the elastic layer 56 in the middle of the outer surface of the elastic layer 56 in the widthwise direction. The cut 58 forms edges at the middle of the outer surface of the elastic layer 56 in the widthwise direction. Here, the cut 58 does not reach the adhesive layer.

The cleaning device 50 also include a pair of bearing members 62 and 64, which support both end portions of the shaft 54 such that the shaft 54 is rotatable. The bearing members 62 and 64 have their inner side in the axial direction of the shaft 54 open and their outer side in the axial direction of the shaft 54 closed by side walls 62A and 64A.

The bearing members 62 and 64 are fixed to respective fixing portions 84 on both side plates 82. Hereinbelow, the bearing member 62 that supports the first end portion of the shaft 54 (for example, an end portion on the side on which the motor 80 is disposed) such that the shaft 54 is rotatable is referred to as a "first bearing member 62", and the bearing member 64 that supports the second end portion of the shaft 54 such that the shaft 54 is rotatable is referred to as a "second bearing member 64".

The inner surface of the side wall 62A of the first bearing member 62 supports a cylindrical support member 66 (see FIG. 4) such that the support member 66 is rotatable. The first end portion of a helical compression spring 68, serving as an example of an urging member, is attached to the support member 66. The second end portion of the helical compression spring 68 is attached to an end surface at the first end of the shaft 54. The helical compression spring 68 supported by the first bearing member 62 urges the first end portion of the shaft 54 toward the second end portion of the shaft 54.

From the inner surface of the side wall 64A of the second bearing member 64, a camshaft portion 70 protrudes to the inner side of the shaft 54 in the axial direction (the external end portion of the camshaft portion 70 in the axial direction is supported by and fixed to the inner surface of the side wall 64A). The end surface at the inner end portion of the camshaft portion 70 in the axial direction forms a pressing cam surface 72 (see FIG. 4), which is tilted in a single direction with respect to the axial direction when viewed in one direction perpendicular to the axial direction.

Figure 4:
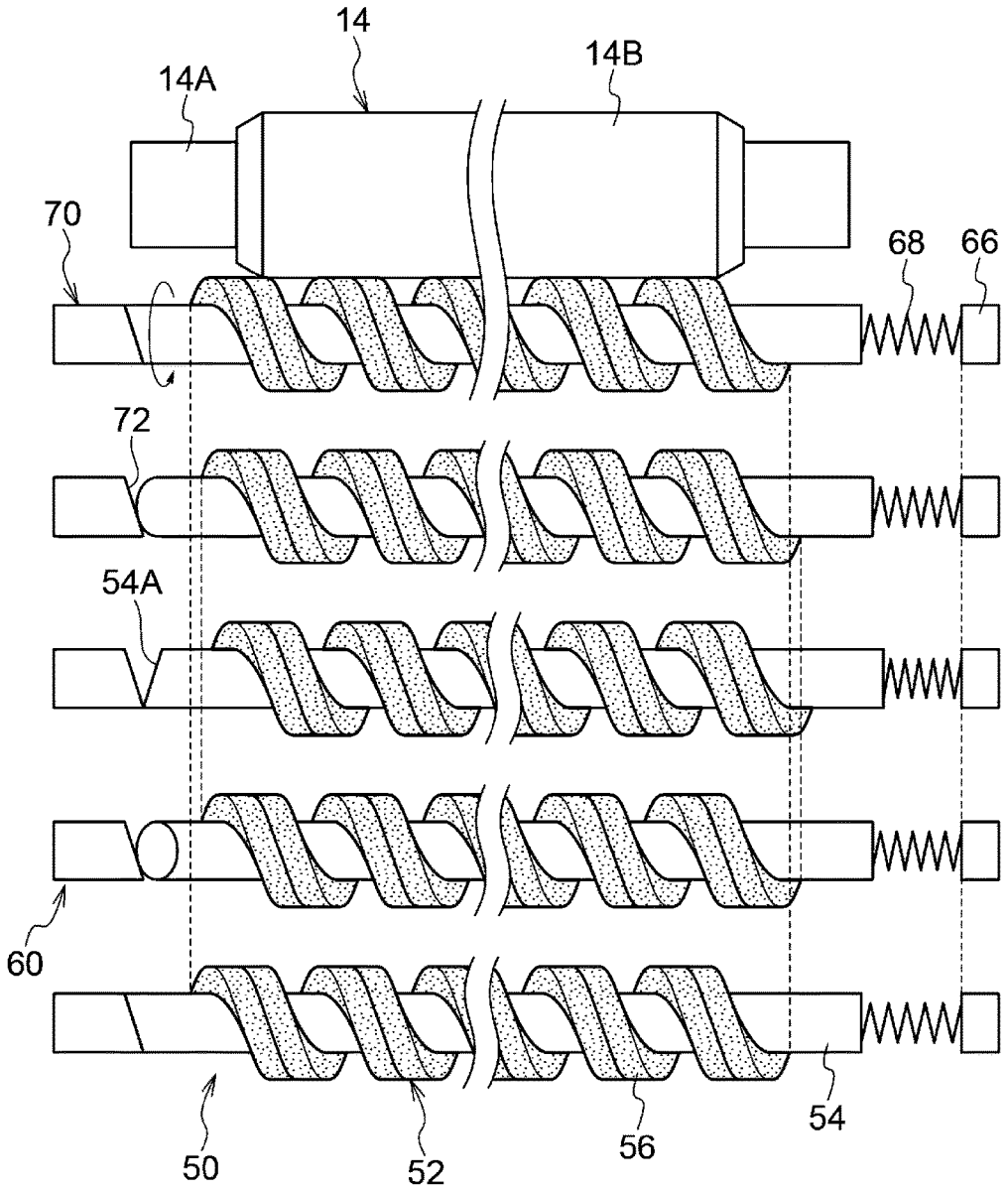
FIG. 4 illustrates an operation of the cleaning device according to the first exemplary embodiment.

When viewed in one direction perpendicular to the axial direction, the end surface at the second end portion of the shaft 54 also serves as a cam surface 54A (see FIG. 4), which is tilted in a single direction with respect to the axial direction. The cam surface 54A is brought into contact with the pressing cam surface 72 by the urging force of the helical compression spring 68. Thus, as illustrated in FIG. 4, when the cleaning roller 52 is driven to rotate by the rotation of the charging roller 14, the cam surface 54A of the shaft 54 rotates over the pressing cam surface 72 around the shaft.

Thus, the shaft 54 moves as a result of being relatively pressed in the axial direction (toward the first end portion) against the urging force of the helical compression spring 68 at a predetermined time point (every time the cleaning roller 52 makes one rotation).

Specifically, the outer surface of the elastic layer 56 of the cleaning roller 52 reciprocates in the axial direction periodically (every time the cleaning roller 52 makes one rotation) relative to the outer circumferential surface of the elastic layer 14B of the charging roller 14.

In this manner, the helical compression spring 68, which urges the first end portion of the shaft 54 toward the second end portion, and the camshaft portion 70, which has the pressing cam surface 72 that relatively presses the cam surface 54A of the shaft 54 on the end surface at second end portion, constitute a moving mechanism 60, which periodically moves the shaft 54 in the axial direction of the shaft 54 together with a rotation of the cleaning roller 52.

The angle at which the cam surface 54A of the shaft 54 on the end surface at the second end portion is tilted and the angle at which the pressing cam surface 72 of the camshaft portion 70 on the end surface at the inner end portion in the axial direction is tilted are appropriately determined to angles that ensure a predetermined amount of movement of the shaft 54 and that do not hinder the cleaning roller 52 from being driven to rotate by the rotation of the charging roller 14. The camshaft portion 70 may be integrally formed on the inner surface of the side wall 64A of the second bearing member 64.

The expression that the cam surface 54A and the pressing cam surface 72 are "tilted in a single direction" refers to that an innermost point on the end surface in the axial direction and an outermost point on the end surface in the axial direction are located on the outer periphery of the end surface, and are spaced 180 degrees apart from each other. As long as satisfying this condition, the end surface (the cam surface 54A or the pressing cam surface 72) may be a flat surface or a curved surface. The "tilt angle" at which the cam surface 54A or the pressing cam surface 72 is tilted is an angle formed by the axis and the line connecting the innermost point on the end surface in the axial direction to the outermost point on the end surface in the axial direction.

The operation of the cleaning device 50 according to the first exemplary embodiment having the above-described structure is described now with reference to FIG. 4 and other drawings.

Foreign matters (contaminants) such as a developer remaining on the photoconductors 12 without being transferred to a recording sheet P are removed from the photoconductors 12 by the cleaning blades 26. Part of foreign matters that slips through each cleaning blade 26 without being removed by the cleaning blade 26 adheres to the outer circumferential surface of the elastic layer 14B of the corresponding charging roller 14. Part of foreign matters such as a developer that floats inside the apparatus body 11 of the image forming apparatus 10 also adheres to the outer circumferential surface of the elastic layer 14B of each charging roller 14.

Foreign matters that have adhered to the outer circumferential surface of the elastic layer 14B of each charging roller 14 are removed by the corresponding cleaning roller 52 driven to rotate by the rotation of the charging roller 14. Specifically, foreign matters that have adhered to the outer circumferential surface of the elastic layer 14B of each charging roller 14 are scraped off by the edge portions to be removed while being wiped by the outer surface of the elastic layer 56 of the cleaning roller 52.

Here, as illustrated in FIG. 4, the cleaning roller 52 is moved to reciprocate once in the axial direction by the moving mechanism 60, including the helical compression spring 68 and the camshaft portion 70, while being driven to make one rotation by the rotation of the charging roller 14.

Specifically, when the cam surface 54A of the shaft 54 rotates around the axis over the pressing cam surface 72 of the camshaft portion 70, the shaft 54 periodically moves (slides) in the axial direction.

Compared to the structure of the cleaning roller 52 that does not periodically move (slide) in the axial direction, the cleaning roller 52 more efficiently cleans the charging roller 14 and more efficiently prevents insufficient cleaning of the charging roller 14. This structure thus partially or completely prevents the occurrence of image defects attributable to insufficient cleaning of the charging roller 14.

Particularly, in this exemplary embodiment, the moving mechanism 60 (the helical compression spring 68 and the camshaft portion 70) that moves the cleaning roller 52 in the axial direction (the axial direction of the charging roller 14) is disposed on the outer side of the shaft 54 of the cleaning roller 52 in the axial direction (on the same axis). Compared to the structure in which the moving mechanism 60 is disposed on the shaft 14A of the charging roller 14, the structure according to this exemplary embodiment partially or completely prevents the charging roller 14 from being vibrated by the moving mechanism 60. Thus, the charging roller 14 is less likely to have charging marks and enhances its life.

Second Exemplary Embodiment

Now, a cleaning device 50 according to a second exemplary embodiment is described. The components the same as those according to the first exemplary embodiment are denoted with the same reference symbols and these same components (including the same function) are not described in details.

Figure 5:
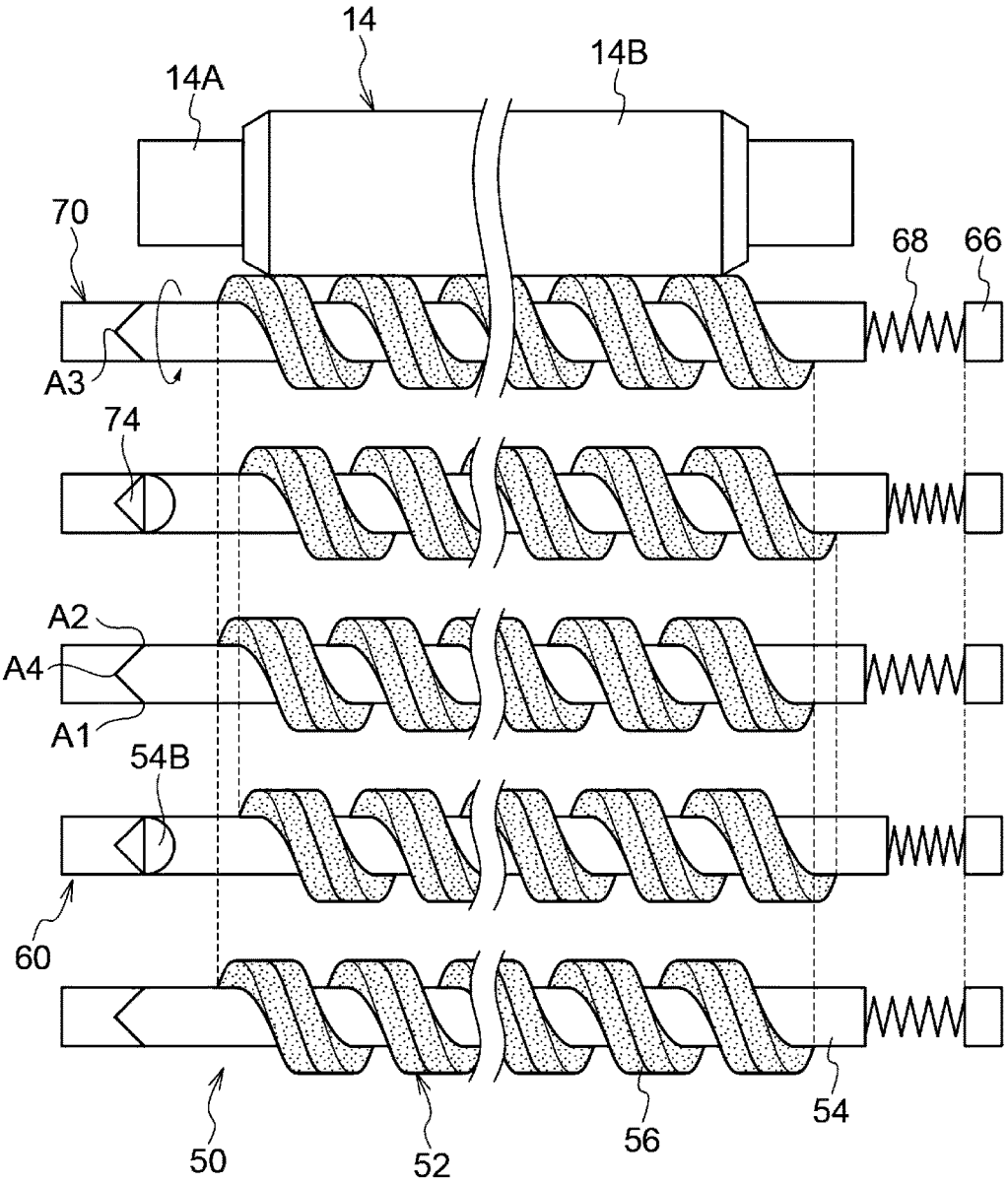
FIG. 5 illustrates an operation of a cleaning device according to a second exemplary embodiment.

As illustrated in FIG. 5, the second exemplary embodiment differs from the first exemplary embodiment in terms of the shape of the cam surface of the shaft 54 and the shape of the pressing cam surface of the camshaft portion 70. Specifically, in the second exemplary embodiment, when viewed in one direction perpendicular to the axial direction, a cam surface 54B of the shaft 54 has such a shape as to protrude into a letter V. When viewed in one direction perpendicular to the axial direction, a pressing cam surface 74 of the camshaft portion 70 has such a shape as to have a letter V recess that is capable of being fitted for the protruding letter V shape.

More specifically, the cam surface 54B has, on its outer periphery, innermost points A1 and A2 on the cam surface 54B in the axial direction and outermost points A3 and A4 on the cam surface 54B in the axial direction. The points A1, A2, A3, and A4 are spaced 90 degrees apart from each other (the line connecting the points A3 and A4 forms the vertex of the letter V when viewed in one direction perpendicular to the axial direction).

When, as described above, the cam surface 54B of the shaft 54 and the pressing cam surface 74 of the camshaft portion 70 are shaped into the respective letter V shapes that fit with each other, the cleaning roller 52 is allowed to reciprocate twice in the axial direction every time the cleaning roller 52 is driven to make one rotation by the rotation of the charging roller 14, as illustrated in FIG. 5.

Specifically, in the second exemplary embodiment, the moving mechanism 60 has a structure that allows the cleaning roller 52 to reciprocate plural times in the axial direction while the cleaning roller 52 makes one rotation. Compared to the structure of the moving mechanism 60 in which the cleaning roller 52 reciprocates once in the axial direction while the cleaning roller 52 makes one rotation, the structure according to this embodiment more efficiently cleans the charging roller 14 and more efficiently prevents insufficient cleaning of the charging roller 14.

The shapes of the cam surface 54B and the pressing cam surface 74 that allow the cleaning roller 52 to reciprocate plural times in the axial direction while the cleaning roller 52 makes one rotation are not limited to the shapes illustrated in FIG. 5. For example, when viewed in one direction perpendicular to the axial direction, the cam surface 54B may have such a shape as to protrude in the arc shape, and the pressing cam surface 74 may have a shape having an arc shape recess so as to be capable of being fitted for the cam surface 54B.

Specifically, the end surface of the shaft 54 at the second end portion suffices if it has multiple cam surfaces 54B, which are rotationally symmetric with respect to the axis. The moving mechanism 60 suffices if it includes the camshaft portion 70 that has multiple pressing cam surfaces 74 that relatively press the multiple cam surfaces 54B, while the cam surfaces 54B are rotating, in the axial direction at a predetermined time point against the urging force of the compression spring 68.

Also in the second exemplary embodiment, the angle at which the cam surface 54B of the shaft 54 on the end surface at the second end portion is tilted and the angle at which the pressing cam surface 74 of the camshaft portion 70 on the end surface at the inner end portion in the axial direction is tilted are appropriately determined to angles that ensure a predetermined amount of movement of the shaft 54 and that do not hinder the cleaning roller 52 from being rotated by the rotation of the charging roller 14.

Third Exemplary Embodiment

Finally, a cleaning device 50 according to a third exemplary embodiment is described. The components the same as those according to the first or second exemplary embodiment are denoted with the same reference symbols and these same components (including the same functions) are not described in details.

Figure 6:
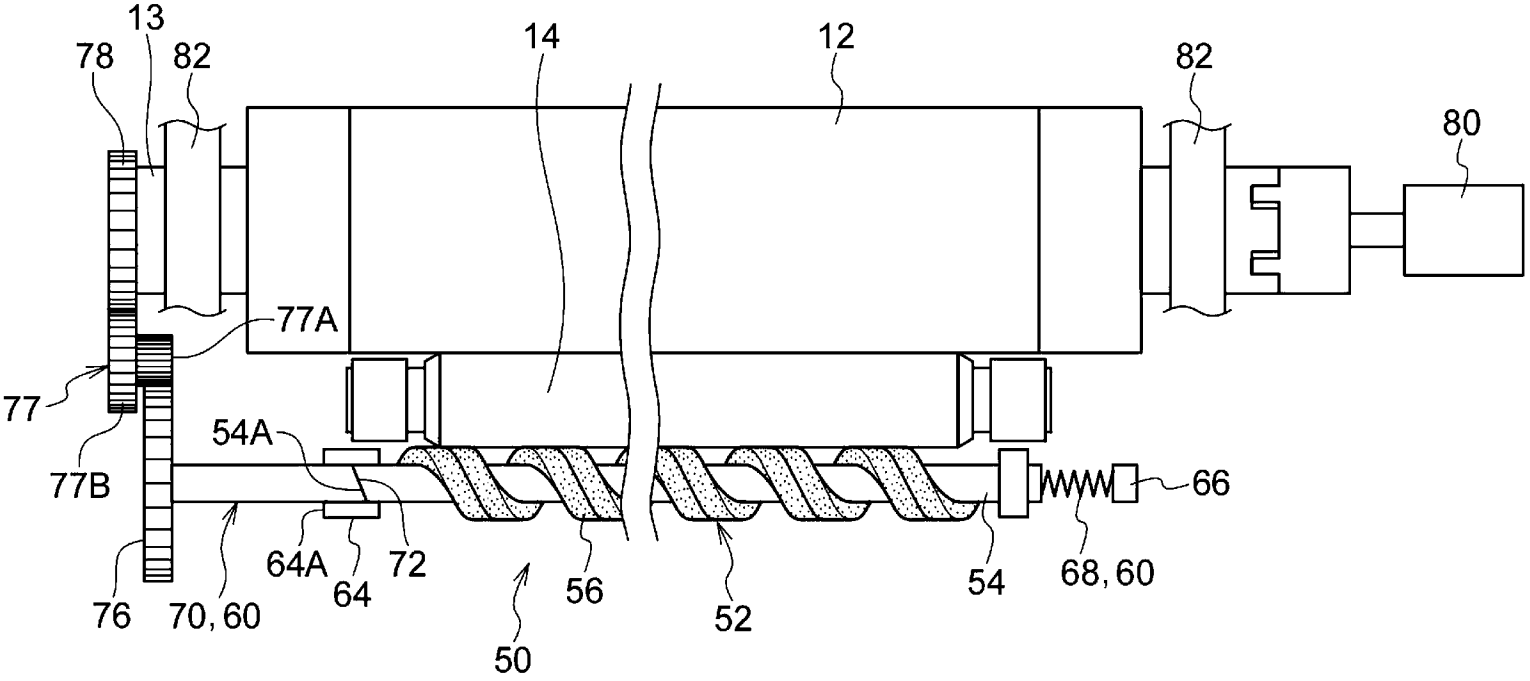
FIG. 6 is a schematic diagram of a cleaning device according to a third exemplary embodiment viewed from the front.

As illustrated in FIG. 6, in the third exemplary embodiment, the camshaft portion 70 is driven to rotate at a rotation speed different from the rotation speed at which the shaft 54 rotates. Specifically, the camshaft portion 70 constituting the moving mechanism 60 extends outward in the axial direction through the side wall 64A of the second bearing member 64, and is rotatably supported by the second bearing member 64.

A core portion of a reduction gear 76 is fixed onto the outer end portion of the camshaft portion 70 in the axial direction. The reduction gear 76 is engaged with a small-diameter portion 77A of a transmission gear 77, including the small-diameter portion 77A and a large-diameter portion 77B integrated with each other. The large-diameter portion 77B of the transmission gear 77 is engaged with a drive gear 78 having a core portion fixed to a drive shaft 13 of the photoconductor 12. The drive gear 78 is disposed on the outer side of the side plate 82 in the axial direction, opposite to the side facing toward the motor 80.

When each photoconductor 12 is driven to rotate by the motor 80, the camshaft portion 70 is driven via the drive gear 78, the transmission gear 77 (the large-diameter portion 77B and the small-diameter portion 77A), and the reduction gear 76 to rotate in the same direction as the photoconductor 12 and the cleaning roller 52 (the shaft 54) at a rotation speed different from (slower than) the rotation speed of the cleaning roller 52 (the shaft 54).

This structure is capable of further prolonging time (adjusting the moving cycle) for which the cleaning roller 52 reciprocates in the axial direction while the cleaning roller 52 makes one rotation compared to the structure in which the camshaft portion 70 is fixed. This structure is thus capable of more efficiently preventing insufficient cleaning of the charging roller 14.

Here, the "different rotation speeds" in this exemplary embodiment include reverse rotation. Specifically, although not illustrated, another transmission gear 77 may be additionally disposed between the drive gear 78 and the reduction gear 76, and the camshaft portion 70 may be driven to rotate at a rotation speed different from (slower than or faster than) the rotation speed of the cleaning roller 52 (the shaft 54) in the direction opposite to the direction in which the photoconductor 12 and the cleaning roller 52 (the shaft 54) rotate.

This structure is capable of increasing the number of times (adjusting the moving cycle) the cleaning roller 52 reciprocates in the axial direction while the cleaning roller 52 makes one rotation, compared to the structure in which the camshaft portion 70 is fixed. This structure is thus capable of more efficiently preventing insufficient cleaning of the charging roller 14.

Thus far, the cleaning device 50 according to the exemplary embodiment has been described with reference to the drawings. The cleaning device 50 according to the exemplary embodiment, however, is not limited to the one illustrated in the drawings and may be appropriately modified within the scope not departing from the gist of the present invention. For example, in the exemplary embodiment, the cleaning roller 52 is driven to rotate by the rotation of the charging roller 14. Alternatively, the cleaning roller 52 may be driven to rotate while having a peripheral speed difference with respect to the charging roller 14.

The cam surface 54A of the shaft 54 according to the first exemplary embodiment and the pressing cam surface 72 of the camshaft portion 70 have shapes that are tilted in a single direction with respect to the axial direction. The camshaft portion 70 according to the first exemplary embodiment is not driven to rotate, unlike that in the case of the third exemplary embodiment. The moving mechanism 60 according to the first exemplary embodiment is thus simpler than the moving mechanisms 60 according to the second and the third exemplary embodiments.

The structure of the elastic layer 56 is not limited to the one helically wound around the outer circumferential surface of the shaft 54. The image forming apparatus 10 including the cleaning roller 52 according to each exemplary embodiment is not limited to the one illustrated in the drawings. Although not illustrated, an image forming apparatus of an intermediate-transfer type may be used as an example of the image forming apparatus 10.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning device comprising:

a cleaning member including a shaft portion and an elastic layer disposed around the shaft portion, the elastic layer being brought into contact with a rotating charging body, the cleaning member cleaning the charging body while rotating;

a first bearing member, which supports a first end portion of the shaft portion while rendering the shaft portion rotatable, and a second bearing member, which supports a second end portion of the shaft portion while rendering the shaft portion rotatable; and a moving mechanism supported by the first bearing member and the second bearing member, the moving mechanism periodically moving the shaft portion in an axial direction of the shaft portion together with a rotation of the cleaning member.

2. The cleaning device according to claim 1, wherein the moving mechanism causes the shaft portion to reciprocate a plurality of times while the cleaning member makes one rotation.

3. The cleaning device according to claim 2, wherein the shaft portion has a plurality of cam surfaces on an end surface at the second end portion, the plurality of cam surfaces being rotationally symmetric with respect to an axis, and wherein the moving mechanism includes an urging member supported by the first bearing member and urging the first end portion of the shaft portion toward the second end portion of the shaft portion, and a camshaft portion supported by the second bearing member and having a plurality of pressing cam surfaces that relatively press the cam surfaces, while the cam surfaces are rotating, in the axial direction at a predetermined time point against an urging force of the urging member.

4. The cleaning device according to claim 3, wherein the camshaft portion is driven to rotate at a speed different from a rotation speed at which the shaft portion rotates.

5. The cleaning device according to claim 1, wherein the shaft portion has a cam surface on an end surface at the second end portion, the cam surface being tilted in a single direction with respect to the axial direction, and wherein the moving mechanism includes an urging member supported by the first bearing member and urging the first end portion of the shaft portion toward the second end portion of the shaft portion, and a camshaft portion supported by the second bearing member and having a pressing cam surface that relatively presses the rotating cam surface in the axial direction at a predetermined time point against an urging force of the urging member.

6. An image forming apparatus, comprising:

the cleaning device according to claim 1;

an image carrier that is capable of holding an image;

a charging body that charges the image carrier;

an exposure device that exposes the image carrier charged by the charging body to light to form an electrostatic latent image on the image carrier; and a developing device that develops the electrostatic latent image formed on the image carrier by the exposure device.

* * * * *